United States Patent [19]

Yoon

[11] 3,946,908

[45] Mar. 30, 1976

[54] TOOTHPASTE DISPENSING APPARATUS

[76] Inventor: Jong Un Yoon, 2431 Finch Ave. West, Apt. 201, Weston, Ontario, Canada

[22] Filed: Sept. 16, 1974

[21] Appl. No.: 506,307

[52] U.S. Cl. ..... 222/162; 222/181; 222/327; 222/390

[51] Int. Cl.[2] ..... B65D 83/00

[58] Field of Search ..... 222/130, 181, 162, 327, 222/390, 168

[56] References Cited

UNITED STATES PATENTS

| | | | |
|---|---|---|---|
| 1,098,008 | 5/1914 | Ash | 222/130 |
| 1,252,719 | 1/1918 | Proctor | 222/390 |
| 2,340,681 | 2/1944 | Oursler | 222/162 X |
| 2,361,594 | 10/1944 | Bonilla | 222/130 X |
| 2,376,944 | 5/1945 | Songer | 222/327 |
| 2,702,942 | 3/1955 | Michaelis | 222/390 X |
| 2,745,575 | 5/1956 | Spencer | 222/390 X |
| 3,029,985 | 4/1962 | Krueger et al. | 222/327 |
| 3,236,268 | 2/1966 | Simpson | 222/386 X |

FOREIGN PATENTS OR APPLICATIONS

| | | | |
|---|---|---|---|
| 384,161 | 1/1965 | Switzerland | 222/187 |
| 949,121 | 9/1956 | Germany | 222/390 |
| 67,176 | 11/1913 | Switzerland | 222/390 |

*Primary Examiner*—Robert B. Reeves
*Assistant Examiner*—Frederick R. Handren

[57] ABSTRACT

A toothpaste dispenser comprises a tubular body portion and a cylindrical base portion, the bottom of the base portion having a threaded aperture. A threaded shaft threadably engages the aperture. A tube which contains toothpaste has a base portion and a dispensing opening. A disc is positioned in the tube near the base and may be axially advanced to force toothpaste out the opening of the tube. Means is provided for releasably connecting the tube to the base portion so that the tube is permitted to rotate relative to the base portion of the dispenser. Upon rotation of the tube the threaded shaft which engages the disc is axially advanced along the tube to dispense the toothpaste at a controlled rate.

12 Claims, 5 Drawing Figures

10
20
12
11
13
14

10
20
32
25
21
23
33
22
24
17
29
15a
15
15a
16
15
30
19
31
12
18
11

24

28
27
28
26

36
38
37
34
35
40
20
39
24

TOOTHPASTE DISPENSING APPARATUS

FIELD OF THE INVENTION

This invention relates to a new container for toothpaste and the like and a device for dispensing toothpaste and the like therefrom.

BACKGROUND OF THE INVENTION

Over the years, the toothpaste industry has maintained the toothpaste tube in relatively the same form without improvements and, as everyone who has ever used toothpaste from a tube knows, it is easy to use at the beginning but after having squeezed it numerous times, it not only becomes awkward to handle but becomes uneconomical in that much of the toothpaste is caught in pockets of deformed tube and is left in the discarded tube. In order to keep the toothpaste tube in a presentable and easily-squeezable condition after it has been used for some time, we are all familiar with the process of gradually squeezing the tube from the end and rolling up the flattened portion of the tube. This takes time and does not ensure the advancement of all of the toothpaste in the tube. Further, after the tube has been squeezed numerous times, the metallic tube may develop a crack due to fatigue through which the toothpaste escapes, thus causing a messy problem. Another problem with the ordinary toothpaste tube is that it is left out on the bathroom counter creating an unsightly appearance. Further, the tube may be placed in any number of drawers in the bathroom and may be easily misplaced.

It is therefore an object of the present invention to overcome the foregoing problems by presenting a tube for toothpaste and the like from which toothpaste, for example, may be dispensed without squeezing of the tube.

It is another object of the present invention to provide an apparatus for dispensing toothpaste and the like from tubes which may be secured in a convenient and easily accessible area.

It is another object of the present invention to provide a dispenser for toothpaste and the like which will aesthetically blend in with the decor of any washroom.

SUMMARY OF THE INVENTION

According to the invention, there is provided a container for toothpaste and the like comprising an elongated tube, an outlet at one end thereof, and a disc of a peripheral configuration corresponding to the cross-sectional configuration of the tube where the disc is disposed co-axially in the tube. The base of the container which is opposite the end of the tube having the outlet, has an opening which permits insertion of a means for axially advancing the disc from the base to the outlet in a piston-movement-like manner.

Further according to the invention there is provided an apparatus for dispensing toothpaste and the like from a tube having a disc movable axially of the tube in a piston-movement-like manner, the apparatus comprising a tubular body portion and a cylindrical base portion. The bottom of the base portion has a threaded aperture co-axial with the axis of the tube, there being a threaded shaft threadably engaging the aperture. Means for releasably connecting the tube to the base portion is provided such that the tube is permitted to rotate relative to the base portion when connected to the base portion, the threaded shaft engaging the disc through an opening in the end of the tube adjacent the base portion.

According to a preferred embodiment of the invention, there is provided a container of a generally tubular configuration for holding, for example, toothpaste, having the conventional outlet and a cap therefor at one end. The container is preferably made of plastic and has a disc axially located therein and located at the end opposite to the outlet when the container is filled with, for example, toothpaste. There is also provided an apparatus for dispensing, for example, toothpaste from a container as described above, which may be attached to a wall or the like for convenient accessibility. A threaded shaft threadably disposed in the tubular body portion of the dispensing apparatus extends through the base portion of the apparatus which is adjacent the end of the container opposite to the outlet when the container is connected to the dispensing apparatus. The shaft extends into the container and into contact with the disc such that when the container is turned about its longitudinal axis, the shaft and the disc are advanced towards the outlet. The amount of, for example, toothpaste, desired is determined by the degree of rotation of the container. After the shaft and the disc have advanced substantially the length of the container, the container is then removed from the dispensing apparatus and discarded and the shaft is then pushed back into the tubular body portion to permit connection of a new container.

DETAILED DESCRIPTION OF THE DRAWINGS

Figures 1, 2, 3, 4, 5:
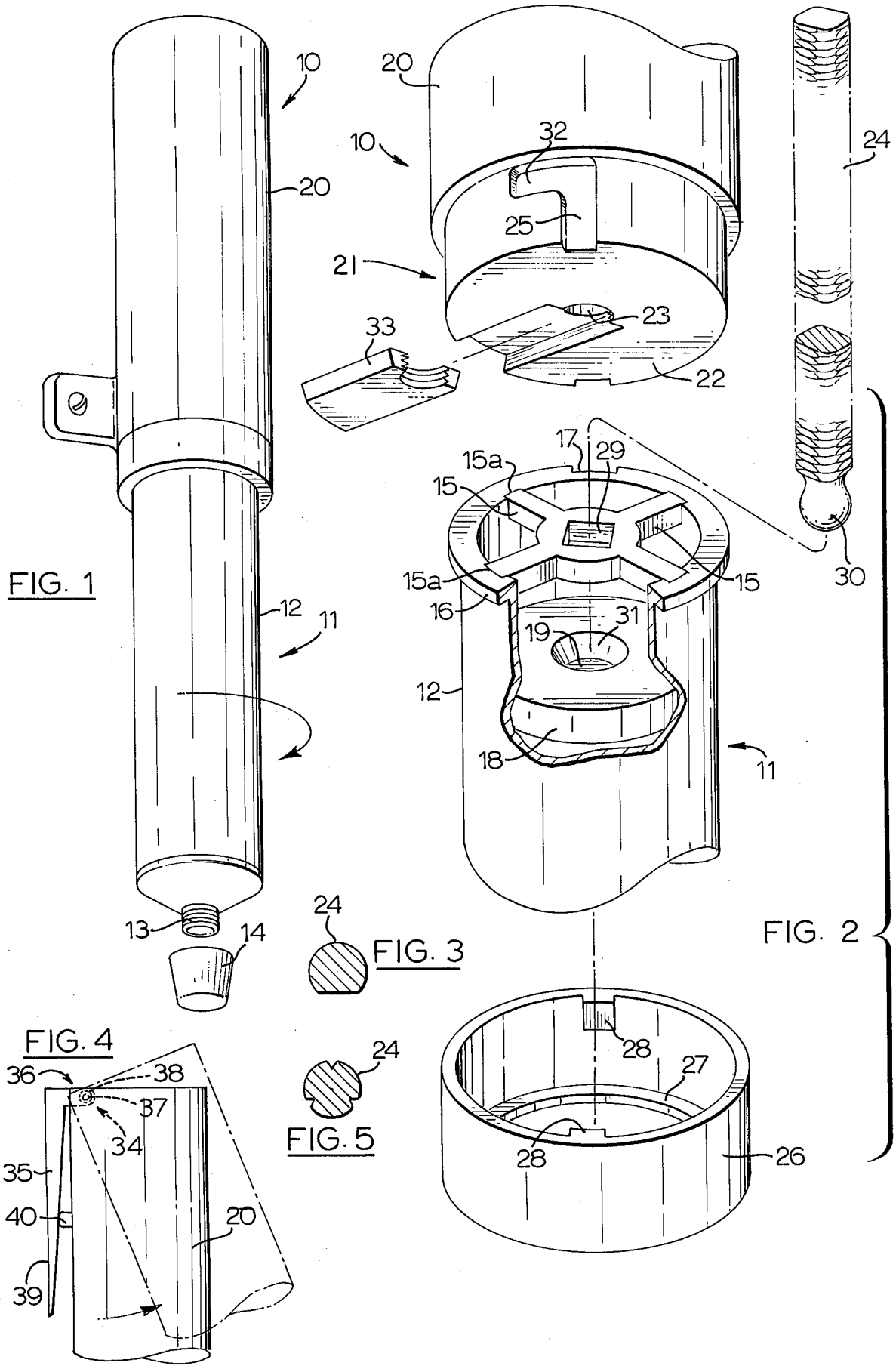
FIG. 1 is an elevational perspective view of the dispensing apparatus and the container.
FIG. 2 is an exploded, elevational, enlarged, cutaway partial view of FIG. 1 showing the connecting means.
FIGS. 3 and 5 are cross-sectional views of two cross-sectional configurations of the shaft.
FIG. 4 is an enlarged view of the tubular body portion of the dispensing apparatus and the attachment means for attaching to walls, etc.

Referring now to the drawings, a specific embodiment of the present invention will now be described. In the drawings there is shown an apparatus generally designated at 10 for dispensing toothpaste and the like from a container generally designated at 11. Container 11 comprises an elongated tube 12 preferably made of plastic having at one end thereof the conventional outlet 13 covered by cap 14. At the end opposite to outlet opening 13 is a removeable base 15 which is press fitted into recesses 15*a*. The recesses 15*a* are formed in outwardly extending annular flange 16 which extends radially beyond the periphery of tube 12, the purpose of which will hereinafter be more fully described. Also located on base 15 and cut out of flange 16 are two diametrically opposed openings 17, the function of which will also hereinafter be more fully described. Also located in tube 12 is disc 18. During the filling of the tube 12 with toothpaste or the like, base 15 is removed and when the tube is full, the disc 18 is inserted in the tube prior to press fitting the base 15 into the respective recesses 15*a*. At the centre of disc 18 is provided an airhole 19 which assists in the smooth dispensing of the toothpaste.

Dispensing apparatus 10 comprises a tubular body portion 20 which is a cylindrical tube. At one end of body portion 20 is base portion 21, also of a cylindrical configuration, which is of a reduced diameter. On the end face 22 of base portion 21 is a threaded opening 23 for threadably engaging threaded shaft 24. When a full tube 12 is attached to dispensing apparatus 10, shaft 24, which is threadably engaged in opening 23 is disposed axially within body portion 20. Base portion 21 has two locking slots 25 of inverted L-shape which slots are located diametrically opposed to each other.

Tube 12 is attached to base portion 21 by means of locking collar 26 which has an inwardly projecting annular flange 27 and two locking studs 28 which are diametrically opposed and adapted to engage L-shaped slots 25.

Shaft 24, which is threadably engaged and extends out of threaded opening 23, extends through opening 29 in base 15. Opening 29 has the same cross-sectional configuration as shaft 24 but is slightly larger to accommodate shaft 24 axially without obstruction but prevents turning of shaft 24 within opening 29.

The end of shaft 24 which extends through opening 29 has a bulb-shaped end 30 which co-operates with socket 31 at the centre of disc 18. Tube 12 is joined to base portion 21 by slipping locking collar 26 over tube 12 and aligning locking studs 28 with notches 17 and locking slots 25 such that locking studs 28 travel through notches 17 and into locking slots 25 longitudinally to its furthest extent and is turned counterclockwise such that locking studs 28 are located in portion 32 of locking slots 25.

With the locking collar 26 in position as described above, tube 12 is free to rotate relative to dispensing apparatus 10 about their common longitudinal axis. The operation is such that upon turning tube 12 in the counterclockwise direction, shaft 24 is also turned in the same direction due to the co-operation between shaft 24 and opening 29. Since tube 12 and apparatus 10 are fixed relative to each other in the longitudinal direction, the turning motion of tube 12 causes shaft 24 to move longitudinally towards outlet 13. As shaft 24 moves in the aforementioned direction, it causes disc 18 to move ahead on shaft 24 in a piston-movement-like manner, thus forcing toothpaste or the like contained in tube 12 out of outlet 13.

Once shaft 24 and disc 18 travel substantially the length of tube 12, thus expending substantially all of the toothpaste or the like contained therein, locking collar 26 may be removed by reversing the procedure as described above and tube 12 may be discarded. Since shaft 24 has threaded itself almost completely beyond end face 22 of base portion 21, it may be pushed longitudinally back into body portion 20 without the necessity of threading. This is accomplished by having part of the end face defining threaded opening 23 on a sliding removable element 33 which is free to slide radially outwardly when the locking collar is removed. Element 33 is fixedly secured when locking collar 26 has connected tube 12 to base portion 21.

Basically, dispensing apparatus 10 may be of any configuration except for base portion 21 which must be compatible with base 15 and locking collar 26. Body portion 20 has attaching means or hanger generally designated at 34 as shown in FIG. 4 comprising a flat strip 35 having a bearing 36 at one end thereof. Pin 37 is journalled through bearings 38 on body portion 20 and also through bearing 36 to pivotally connect the hanger to the body portion. The flat surface 39 on strip 35 may have self-adhesive material for sticking to walls, doors or cupboards, etc. Other fastening means such as screws may be used to fasten the hanger to walls and the like. Attached to the side of strip 35 adjacent the body portion 20 is rest-stop 40 which keeps the dispensing apparatus spaced apart from the wall. Thus it can be seen that the dispensing apparatus and the tube 12 may be pivotally adjusted away from the wall for easier access to the toothpaste.

Further, the body portion 20 may be designed to hold or be a receptacle for tooth brushes and the like which puts everything into a neat compact package.

Variations may also be made in the method of affixing dispensing apparatus 10 to the wall. Further, body portion 20 may be part of a stand which is free standing and is not attached to the wall.

Further variations may be made in the configuration of shaft 24 as illustrated in FIGS. 3 and 5. Basically, shaft 24 requires sufficient surface for threading into opening 23 while at the same time presenting a non-circular surface into opening 29 which has the same shape as the shaft such that shaft 24 will not turn in opening 29.

It is also understood that the method of joining tube 12 to base portion 21 as described above is only one specific embodiment and other locking and joining means may be used to provide the same effect.

Although a preferred embodiment of the invention has been shown and described, it is understood that variations may be made by those skilled in the art without departing from the spirit of the invention or the scope of the appended claims.

I claim:

1. An apparatus for dispensing toothpaste and the like comprising in combination a tube having an outlet at one end thereof, a disc of a peripheral configuration corresponding to the cross-sectional configuration of said tube disposed co-axially in said tube, a base located at the end of said tube opposite said outlet, and a tube holder having a tubular body portion and a cylindrical base portion, the bottom of said cylindrical base portion having a threaded aperture co-axial with the longitudinal axis of said cylindrical base portion, a threaded shaft threadably engaging said threaded aperture, said base of said tube having an opening which is adapted to permit free passage of said shaft through said opening so that the shaft engages said disc, the configuration of said threaded shaft and said opening being such that the opening surrounds said shaft in a manner to preclude relative rotational movement between said threaded shaft and the base of said tube when said tube is rotated, means for releasably connecting the tube to said base portion such that the tube is permitted to rotate relative to said cylindrical base portion when connected to said cylindrical bas portion, said threaded shaft engaging said disc through the opening provided in said tube base when the apparatus is assembled, rotation of said tube causing said threaded shaft to advance into said tube thereby advancing said disc to dispense the contents of said tube.

2. A container as claimed in claim 1 wherein said tube is cylindrical in shape and said disc is circular.

3. A container as claimed in claim 2 wherein said disc has an air-hole through its centre.

4. A container as claimed in claim 1 wherein said container has adjacent said base an annular radially outwardly extending flange, said base having said opening defined in a central body portion thereof and radiating outwardly from said central body portion is a plurality of arms; said flange has a number of recesses formed therein equal in number to the number of arms and adapted to receive a respective arm whereby said base is press-fitted onto said container.

5. A container as claimed in claim 4 wherein said flange has two diametrically opposed notches in the periphery thereof which are positioned elsewhere in said flange than where said recesses are positioned.

6. An apparatus as claimed in claim 1 wherein said means for releasably connecting the tube to said base portion comprises a collar having a radially inwardly projecting annular flange and two diametrically opposed locking studs, said base portion having two diametrically opposed inverted "L" shaped locking slots adapted to receive said locking studs.

7. An apparatus as claimed in claim 1 wherein said threaded shaft has a generally circular cross-section with at least one segment removed, the configuration of said opening in said tube base having a similar cross-section.

8. An apparatus as claimed in claim 7 wherein said threaded shaft has a generally circular cross-section with a plurality of segments removed, the configuration of said opening in said tube base having a similar cross-section.

9. An apparatus as claimed in claim 1 wherein a section of the base portion defining said threaded aperture is displaceable when the tube is disconnected from said base portion.

10. An apparatus as claimed in claim 1 wherein said tubular body portion has means for attaching to a wall or the like.

11. An apparatus as claimed in claim 10 wherein said means for attaching is pivotally connected to said tubular body portion.

12. A container for toothpaste and the like comprising an elongated tube, an outlet at one end thereof, a disc of a peripheral configuration corresponding to the cross-sectional configuration of said tube disposed coaxially in said tube, the base of said container which is an end of said tube opposite said outlet having an opening which permits insertion of means for axially advancing said disc from said base to said outlet in a piston-movement-like manner, said container having adjacent said base an annular radially outwardly extending flange, said base having said opening defined in a central body portion thereof and radiating outwardly from said central body portion is a plurality of arms; said flange having a number of recesses formed therein equal in number to the number of arms and adapted to receive a respective arm whereby said base is press-fitted onto said container, said flange having two diametrically opposed notches in the periphery thereof which are positioned elsewhere in said flange than where said recesses are positioned.

* * * * *